US006192527B1

(12) United States Patent
Paul

(10) Patent No.: US 6,192,527 B1
(45) Date of Patent: Feb. 27, 2001

(54) WATER JET PERSONAL HYGIENE FIXTURE FOR INSTALLATION ON A TOILET BOWL

(76) Inventor: Raj Paul, 4911 Brisbois Dr., N.W., Calgary, Alberta (CA), T2L 2G3

( * ) Notice: Subject to any disclaimer, the term of this patent is extended or adjusted under 35 U.S.C. 154(b) by 0 days.

(21) Appl. No.: 09/488,918

(22) Filed: Jan. 21, 2000

(51) Int. Cl.[7] ..... A47K 3/20
(52) U.S. Cl. ..... 4/420.4; 4/447; 4/448
(58) Field of Search ..... 4/420.4, 420.1, 4/420.2, 420.3, 420.5, 443, 444, 445, 446, 447, 448, 596, 598, 605

(56) References Cited

U.S. PATENT DOCUMENTS

| | | | | |
|---|---|---|---|---|
| 1,874,169 | * | 8/1932 | Campus . | |
| 1,960,839 | * | 5/1934 | Campus . | |
| 2,058,003 | * | 10/1936 | Davies . | |
| 3,156,929 | * | 11/1964 | Davis, Jr. . | |
| 3,430,268 | * | 3/1969 | Zoberg . | |
| 3,605,124 | * | 9/1971 | Marcard et al. | 4/420.2 |
| 3,879,769 | | 4/1975 | Slawinski et al. . | |
| 3,925,826 | * | 12/1975 | Huyot et al. . | |
| 4,041,553 | * | 8/1977 | Sussman . | |
| 4,197,594 | | 4/1980 | Butterfield . | |
| 4,764,997 | * | 8/1988 | Anderson et al. | 4/420.4 |
| 4,807,311 | | 2/1989 | Ingels . | |
| 4,995,121 | * | 2/1991 | Barker | 4/420.2 |
| 5,101,520 | * | 4/1992 | Lockhart | 4/447 |
| 5,263,205 | | 11/1993 | Leunissen . | |
| 5,279,001 | | 1/1994 | Vento . | |
| 5,287,566 | | 2/1994 | Azada . | |
| 5,504,948 | | 4/1996 | Chandler . | |
| 5,566,402 | | 10/1996 | Agha el-Rifai et al. . | |
| 5,630,234 | | 5/1997 | Childs . | |
| 5,647,069 | | 7/1997 | Han et al. . | |
| 5,652,971 | | 8/1997 | Wokas . | |
| 5,659,901 | | 8/1997 | Derakhshan . | |
| 5,704,077 | | 1/1998 | Rodriguez . | |
| 5,722,097 | | 3/1998 | Deveer . | |
| 5,799,341 | | 9/1998 | Rodas . | |
| 5,809,585 | | 9/1998 | Farshad . | |

* cited by examiner

*Primary Examiner*—Steven O. Douglas
*Assistant Examiner*—Khoa D. Huynh
(74) *Attorney, Agent, or Firm*—Arne I. Fors.

(57) ABSTRACT

A water jet personal hygiene fixture for installation on a toilet bowl, comprising hot and cold water control valves to produce warm water from existing pipes in a bathroom, a pivotally-mounted nozzle to produce a water jet, control handles to actuate the nozzle in a vertical arc and to control water pressure and flow, and water shut-off valves. A base plate allows installation of the fixture on the toilet bowl in a space between the toilet bowl rim and the toilet seat, the seat having a cut-out to accommodate vertical travel of the nozzle. A novel handtowel glove is formed from a planar sheet of absorbent material into a tubular shape with a closed end as an aid for dab drying the user and the toilet seat area after the use of the fixture.

5 Claims, 11 Drawing Sheets

FIG. 11.
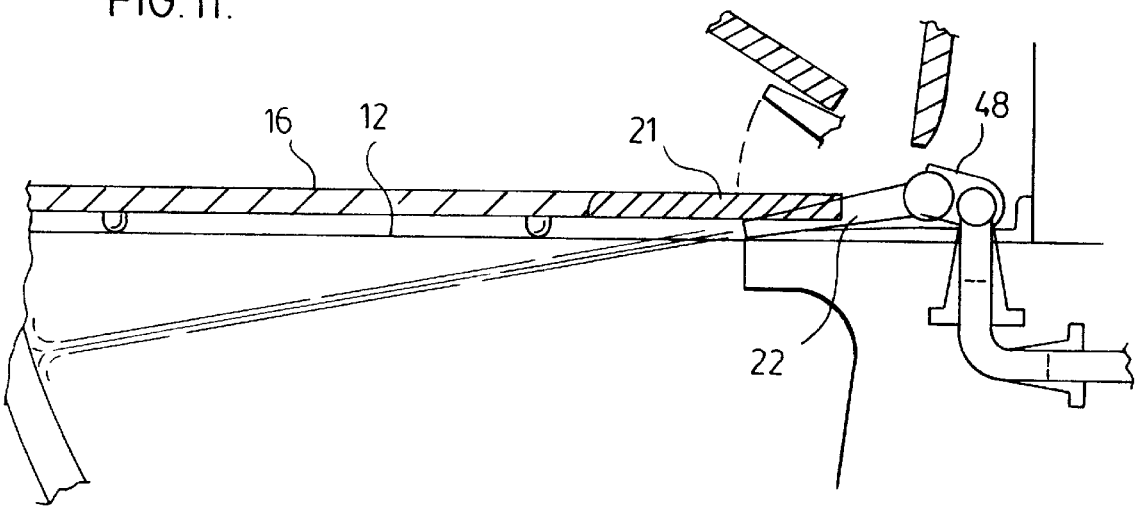
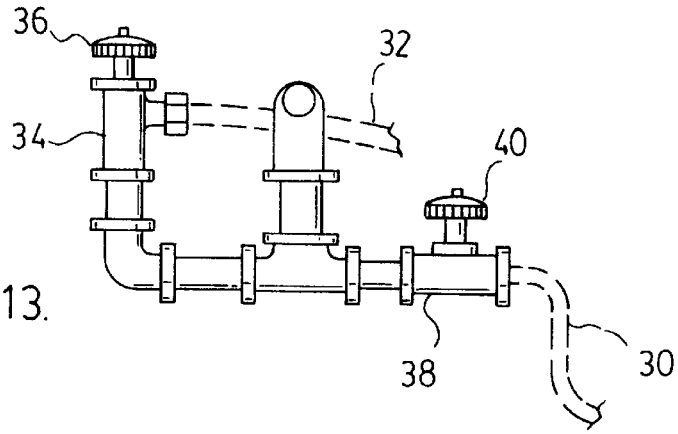
FIG. 13.

WATER JET PERSONAL HYGIENE FIXTURE FOR INSTALLATION ON A TOILET BOWL

BACKGROUND OF THE INVENTION (i) Field of the Invention

The present invention relates to a personal hygiene fixture adapted to be retrofitted onto a toilet bowl and, more particularly, relates to a personal hygiene fixture for producing a controllable water jet of variable temperature, pressure and flow, pivotal through a vertical arc.

(ii) Description of the Related Art

The basic personal hygiene system in most households in the World includes a bathroom having a conventional toilet system comprised of a toilet bowl, a toilet seat and a cover lid combination, a tank for flushing the toilet bowl, a cold water supply to the tank and a toilet-paper roll holder. In some such bathrooms, personal preferences of people preclude the use of toilet paper and favour water washes in the form of a separate bidet. The separate bidet is well-known and is commonly used in some parts of Europe but is sparingly used in North America. It generally includes a separate toilet type bowl without an attached lid or a toilet water tank. It normally is located close to the toilet bowl with a stationary water jet discharge nozzle attached at the inside bottom of the bowl to spray pressurized water on to the user, when the user sits on the bidet bowl. The drawbacks of this solution are that, firstly, the user has to get up from the toilet seat and move to the bidet bowl for water spray cleaning and, secondly, the bathroom size and its cost increase as a consequence of the presence and the size of the bidet bowl which is, normally, as large as the toilet bowl itself. Moreover, thirdly, since the nozzle is seated inside the bottom of the bidet bowl, the fixture is not completely hygienic, although still preferred by some over the use of toilet paper.

The alternative to the separate bidet bowl is the use of a portable bidet type fixture which is attachable to the existing toilet bowl or to the toilet seat. The portable fixture has advantages, in that, it is cost effective as the bathroom size need not change and, also, the user does not have to get up from the toilet seat for water spray cleaning.

A host of designs has been proposed for this class of fixtures. Some of these fixtures have been produced commercially in a limited fashion, but none has gained popularity. The following patents describe some of the relevant features of proposed various designs of bidet-type fixtures attachable to toilet bowls or adapted to be mounted in proximity to toilet bowls.

U.S. Pat. No. 5,809,585 proposes a unit attached to a wall near the toilet bowl that has a long hose with a nozzle to clean the user. The fixtures proposed in U.S. Pat. Nos. 5,279,001, 5,263,205 and 3,879,769 have water jet discharge nozzles fixed to the toilet seat but the nozzle is exposed to spent water during use, and hence is not hygienically sanitary. Moreover, these designs lack the flexibility of close control of the water jet.

U.S. Pat. Nos. 5,799,341,5.,722,097, 5,704,077, 5,659,901, 5,652,971,5,647,069, 5,630,234, 5,566,402, 5,504,948, 5,287,566, 4,807,311 and 4,197,594 in common disclose nozzles exposed to spent water during use since the nozzle is located inside the toilet bowl. These designs accordingly are not hygienically acceptable.

SUMMARY OF THE INVENTION

It is an object of this invention to provide a personal hygiene fixture that is practical and usable by the public at large.

It is a further object of the invention to provide a fixture that can be installed on and incorporated with existing toilet systems and which is user friendly, economical and hygienic.

A further object of the invention is the provision of a simple, rugged, reliable and cost effective fixture which is easy to maintain to and service.

In its broad concept, the water jet personal hygiene fixture of the invention for installation on a toilet bowl having a pair of attachment bolts comprises a base plate having a pair of holes for receiving said attachment bolts and removably attaching the base plate to the toilet bowl, a water jet nozzle pivotally mounted on the base plate for delivering a flow of water under pressure at an angle through a vertical arc, control means operatively connected to the water jet nozzle for pivoting said water jet nozzle to a desired position within the vertical arc, a variable flow valve in series with the water jet nozzle for controlling flow of water under pressure to the water jet nozzle mounted on the base plate, control means operatively connected to the flow valve for actuating and adjusting the flow valve, conduit means for connecting said flow valve to separate sources of hot and cold water supplies, a mixing valve in series with said conduit means having valve means for adjusting the hot and cold water supplies to achieve a desired water temperature to said flow valve, and a toilet seat pivotally mounted on the base having a cut-out at the water jet nozzle to permit unobstructed flow of water from the water jet nozzle through the vertical arc of travel of said water jet nozzle.

The control means operatively connected to the water jet nozzle is an elongated vertically pivotal lever pivotally mounted at an end of the base plate, said lever having a distal end in proximity to one side of the toilet bowl. The control means operatively connected to the flow valve, is an elongated lever pivotally mounted on the flow valve at the opposite end of the base plate, said lever having a distal end in proximity to the opposite side of the toilet bowl. A temperature read-out operatively connected to a temperature probe may be located for convenience in the elongated control lever or on the base plate.

The mixing valve preferably is a Y-valve or two valves in 'T' formation having a cold water conduit and a hot water conduit connected thereto, said Y-valve having hot and cold water valve means for adjusting the relative flow of hot and cold water.

BRIEF DESCRIPTION OF THE DRAWINGS

The water jet personal hygiene fixture of the invention will now be described with reference to the accompanying drawings, in which;

FIG. 11 is a sectional view taken along line 11—11 of FIG. 10;

FIG. 13 is a side view of FIG. 12;

DESCRIPTION OF THE PREFERRED EMBODIMENT

Figure 1:
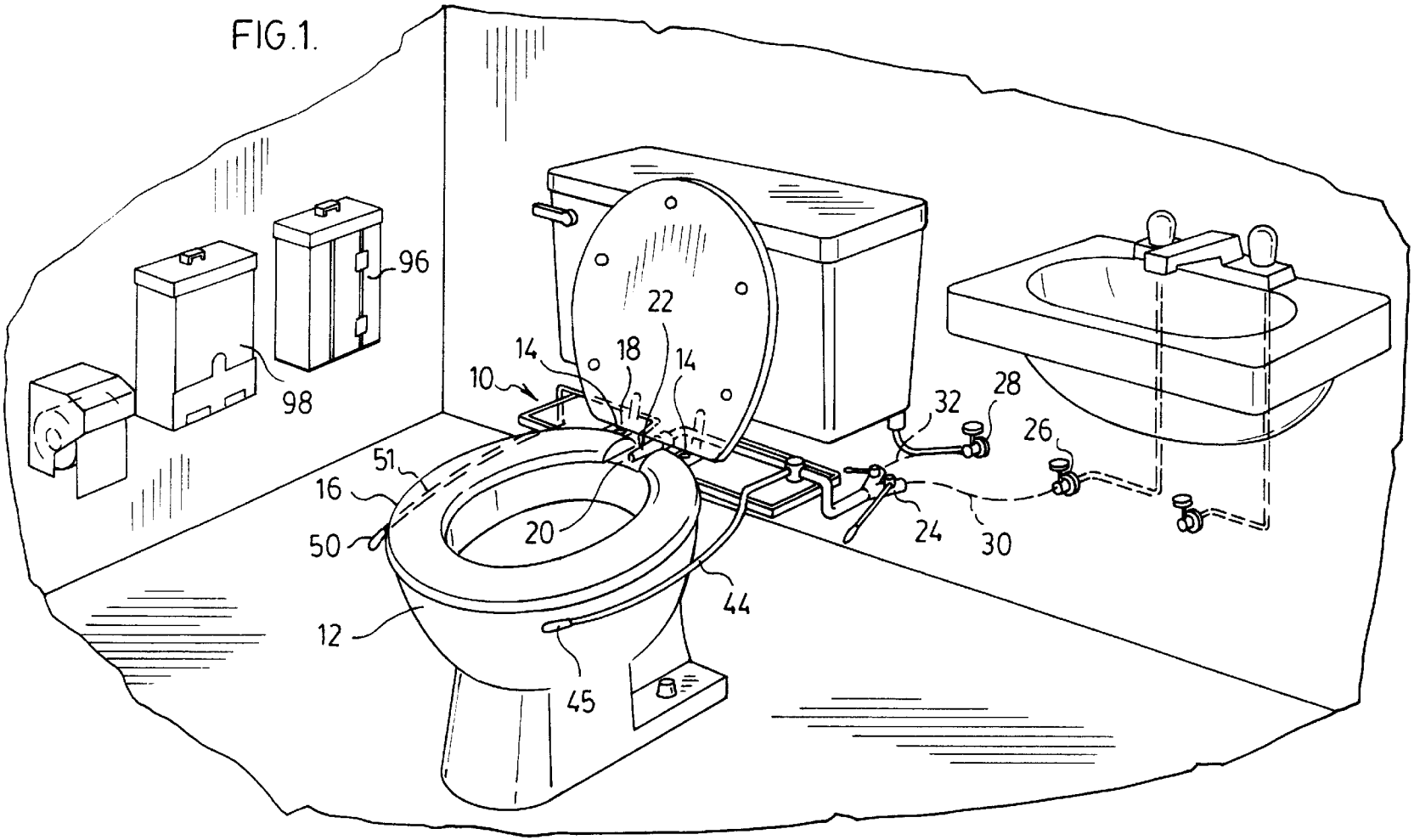
FIG. 1 is a perspective view of the toilet system that includes a toilet bowl, a water tank, a wash sink and the fixture of the present invention attached to the toilet bowl, and a clean handtowel holder and a soiled or used handtowel receptacle.
Figure 2:
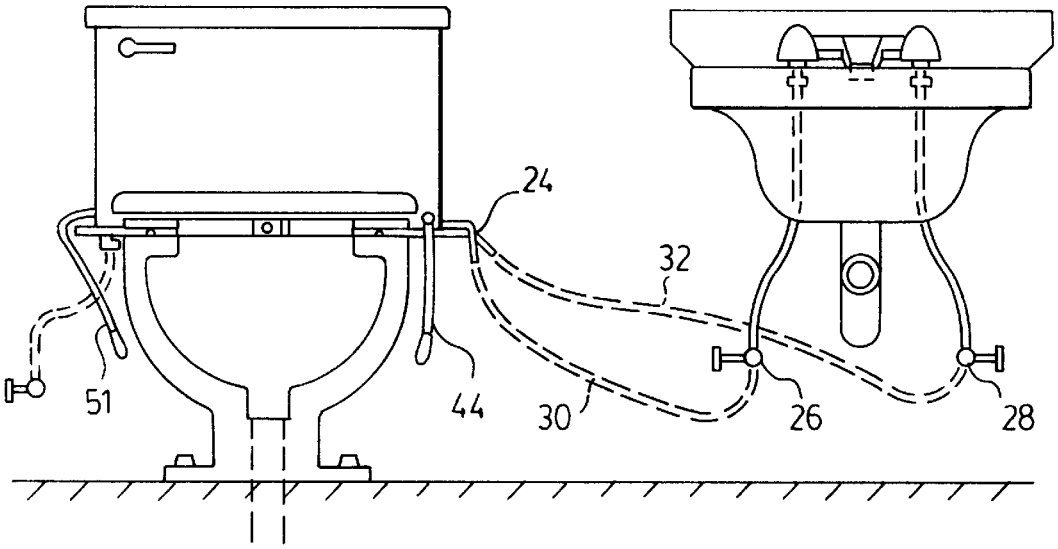
FIG. 2 is a front elevation of the fixture shown in FIG. 1 connected to cold and hot water outlets.
Figure 3:
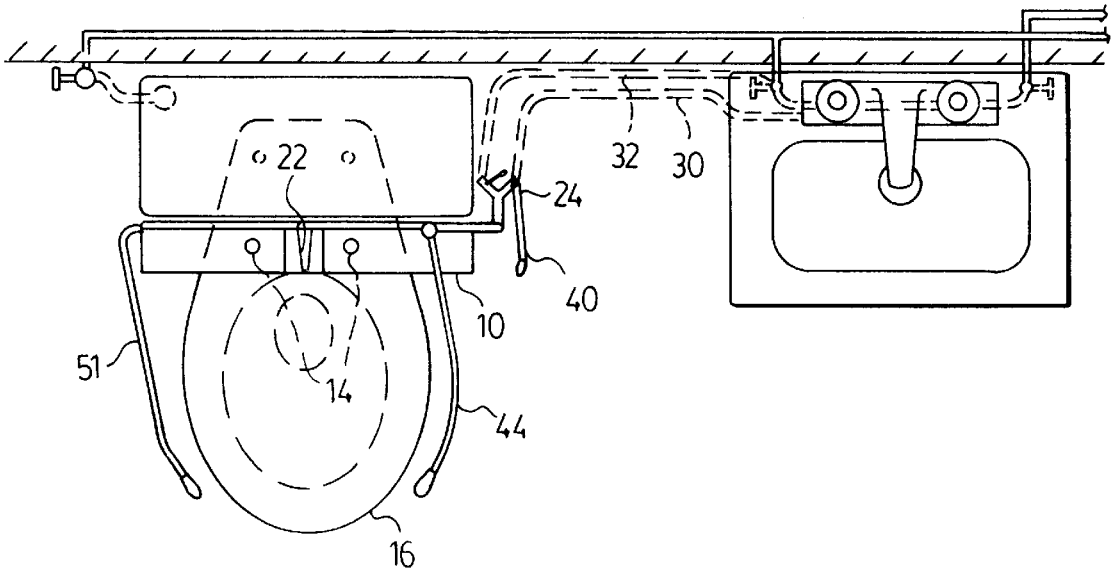
FIG. 3 is a plan view of the apparatus shown in FIG. 1.

With reference to FIGS. 1–14 of the drawings, an embodiment of the personal hygiene fixture of the invention comprises a base 10 secured to a toilet bowl 12 by nut-and-bolt connectors 14 which typically secure a toilet seat hinge to the toilet bowl, which pass through holes 15 in base 10. Toilet seat 16, attached to base 10 by hinge 18, has a rear cut-out depicted by numeral 20 to permit unobstructed flow of a water jet from jet nozzle 22. The cut-out 20 preferably is covered by lid 21, FIGS. 7, 8, 10 and 11, attached to the nozzle 22.

In accordance with the embodiment illustrated in FIGS. 1–14, mixing valve 24 is connected to valved hot and cold water lines 26, 28 respectively by conduits 30, 32. Cold water conduit optionally can be connected to toilet cold water line 28 (FIG. 1). Mixing valve 24, such as a Y-valve (FIG. 4), has a cold water valve 34 with control lever 36 and a hot water valve 38 with control lever 40 to permit selection of a desired warm water temperature for water to flow to flow valve 42. Y-valve 24 having ball shutoff valves, such as manufactured by Yardworks Canada, butterfly shut-off valves, or screw shut-off valves, such as manufactured by Moen Incorporated or Brasscraft Canada are suitable for adjusting water flow.

A flow of adjusted warm water at pressures up to 150 psi, controlled by shut-off water valve 42 such as a ball shut-off valve manufactured by B & K Industries having control lever 44 readily accessible to a user, passes through pipe 43 to a jet nozzle 22 (see FIG. 2) which is pivotally mounted on a right-angle flexible elbow 48 (FIG. 4) such as manufactured by Teledyne Water Pik to allow the jet nozzle 22 to traverse through a vertical arc from the horizontal to about 45° above and 20° below the horizontal. Arcuate travel and positioning of nozzle 22 is controlled by lever 51 which is pivotally mounted by bushings 52 onto base 10. Lever 51 has an offset arm extension 54 pivotally connected to the underside of nozzle 22, shown most clearly in FIGS. 7–13, to translate vertical pivotal movement of lever 50 to desired vertical pivotal movement of offset arm 54 and consequently effect the movement of the nozzle 22.

Figure 4:
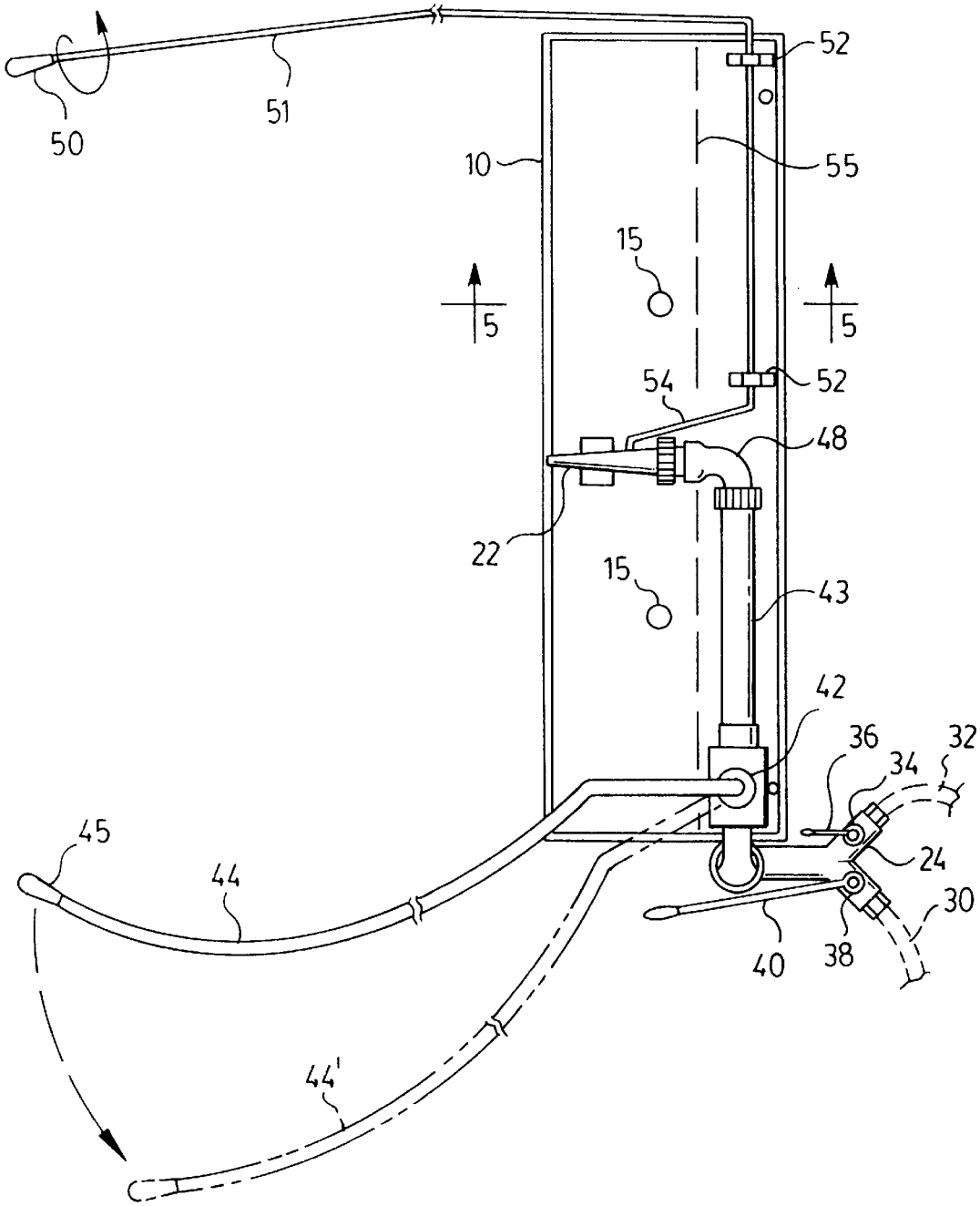
FIG. 4 is a detailed plan view of the fixture of the invention attachable to a toilet bowl.
Figure 5:
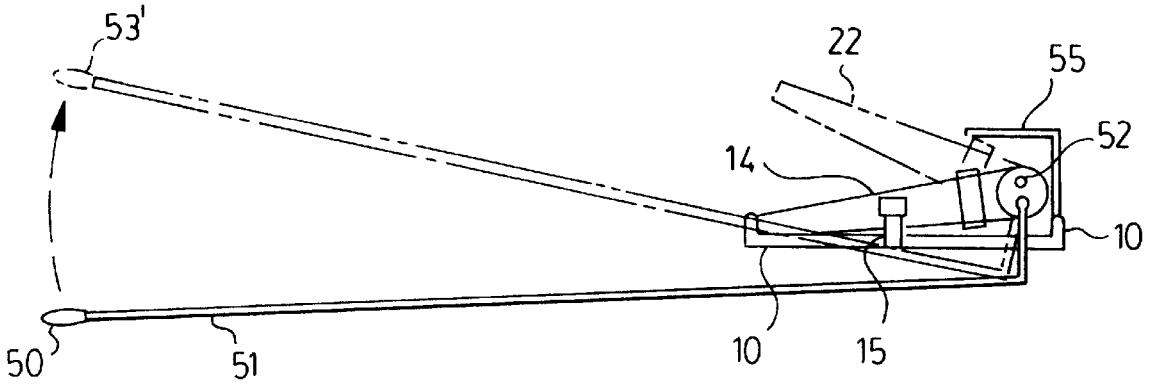
FIG. 5 is a side elevation taken along line 5—5 of FIG. 4.
Figure 7:
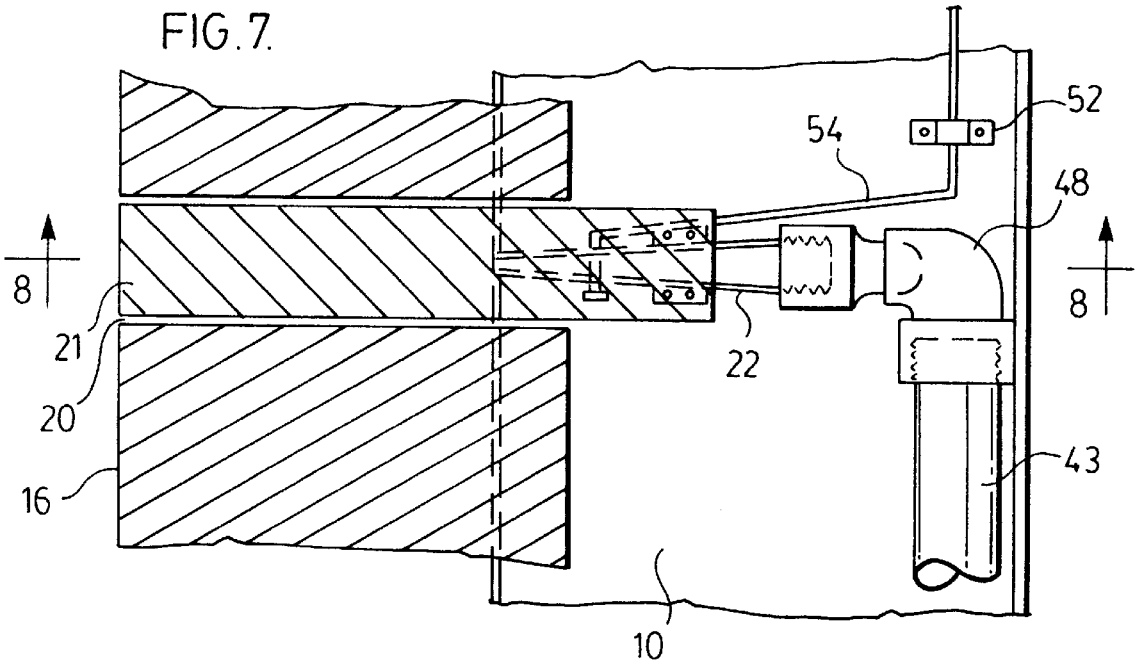
FIG. 7 is a plan view, partly in section, of the nozzle relative to the toilet seat.
Figure 6:
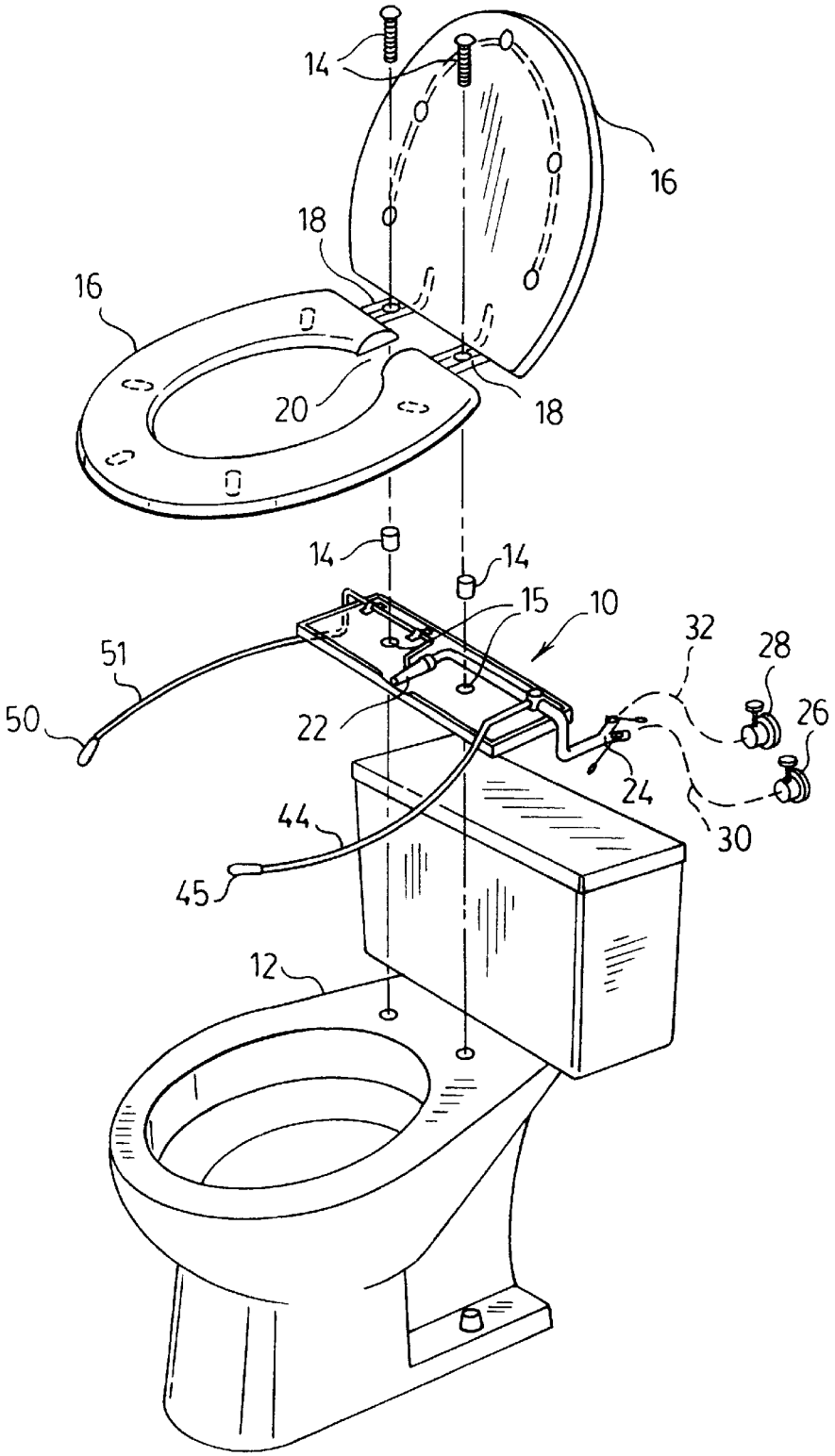
FIG. 6 is an exploded perspective view of the base of the invention relative to a toilet bowl and toilet seat.
Figure 8:
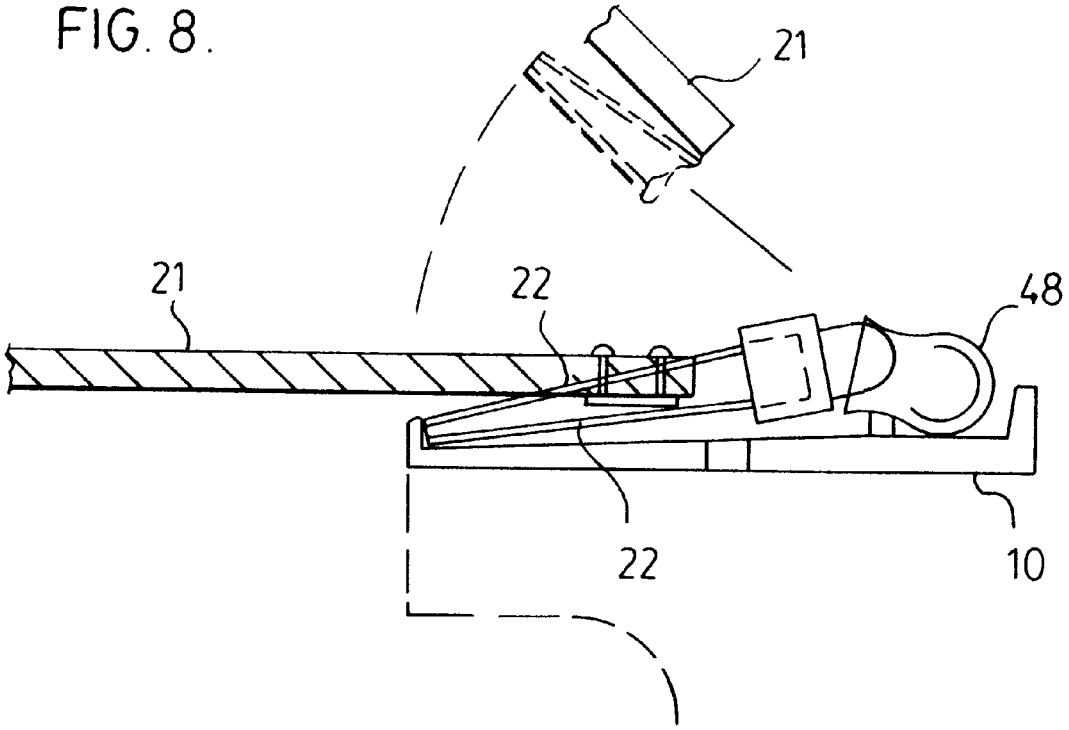
FIG. 8 is a section taken along line 8—8 of FIG. 7.
Figure 9:
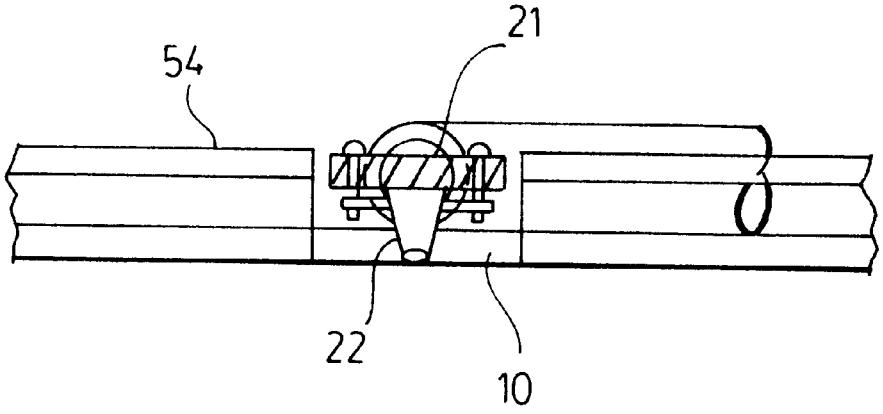
FIG. 9 is a front view of the nozzle shown in FIG. 8.
Figure 10:
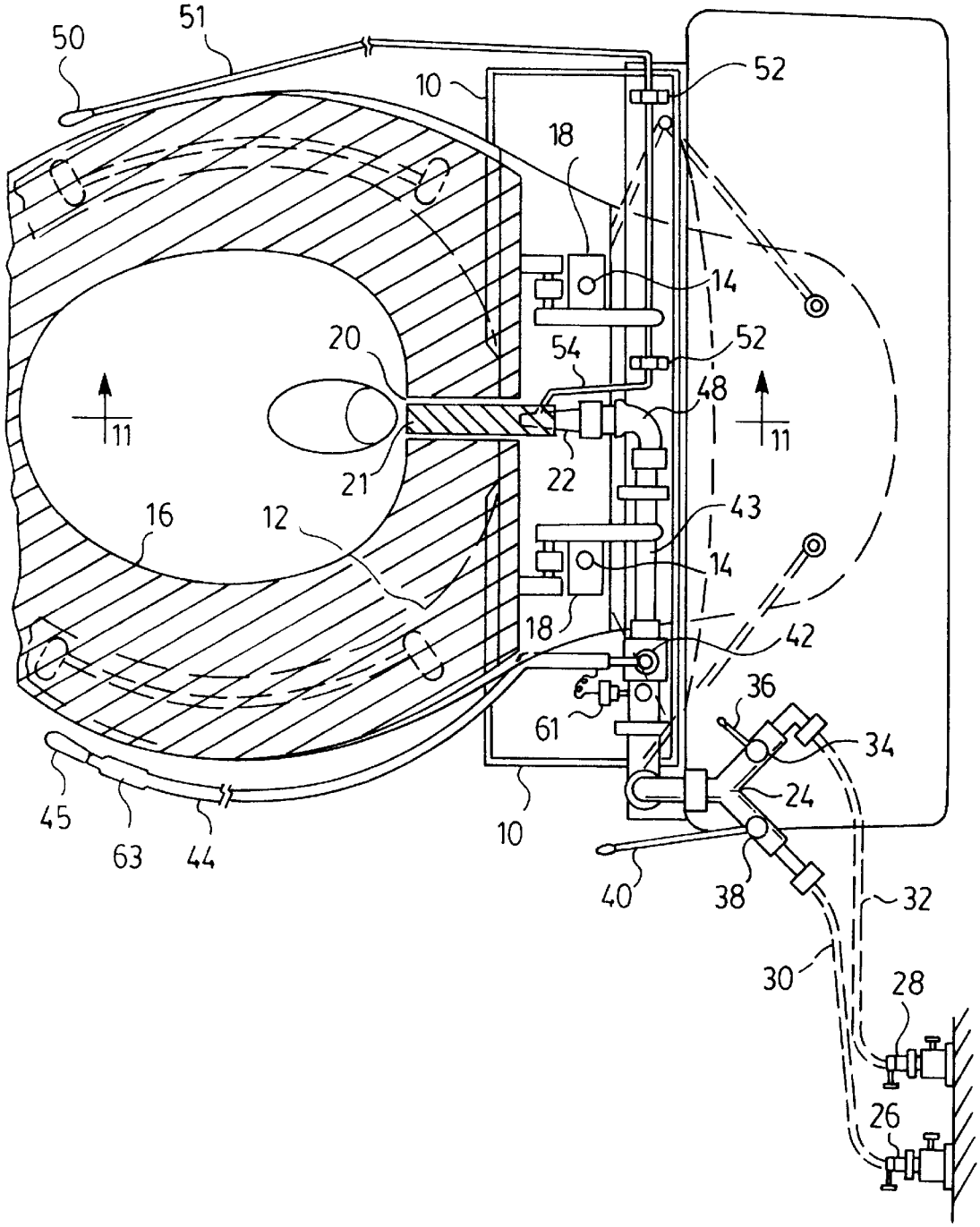
FIG. 10 is a plan view of the fixture assembled on the toilet bowl, with seat cross hatched in section.

In use, the water temperature is adjusted by actuating control levers 36, 40 of mixing valve 24 having cold and hot water valves 34, 38 and the rate of water flow and pressure adjusted by lateral movement of the distal end 45 of control arm 44 of flow valve 42 to a position such as depicted by numeral 44' of FIG. 4. The water temperature can be monitored visually by a temperature probe 61 (FIG. 14) installed in conduit 43 connected to a read-out 63, of a type sold by InterTan Texas Inc., installed in handle 44 by a wire conductor 65. The vertical angle of jet nozzle 22 is adjusted by vertical pivotal movement of the distal end 50 of lever 51 as depicted by numeral 53' in FIG. 5, to provide a jet of warm water at a desired angle and at a desired velocity according to adjusted water pressure to suit the individual user. During use, the user can manipulate handles 36, 40, 44, 51 to adjust the various parameters such as water jet temperature, pressure, and flow and angle, instantly according to his wishes.

Figure 12:
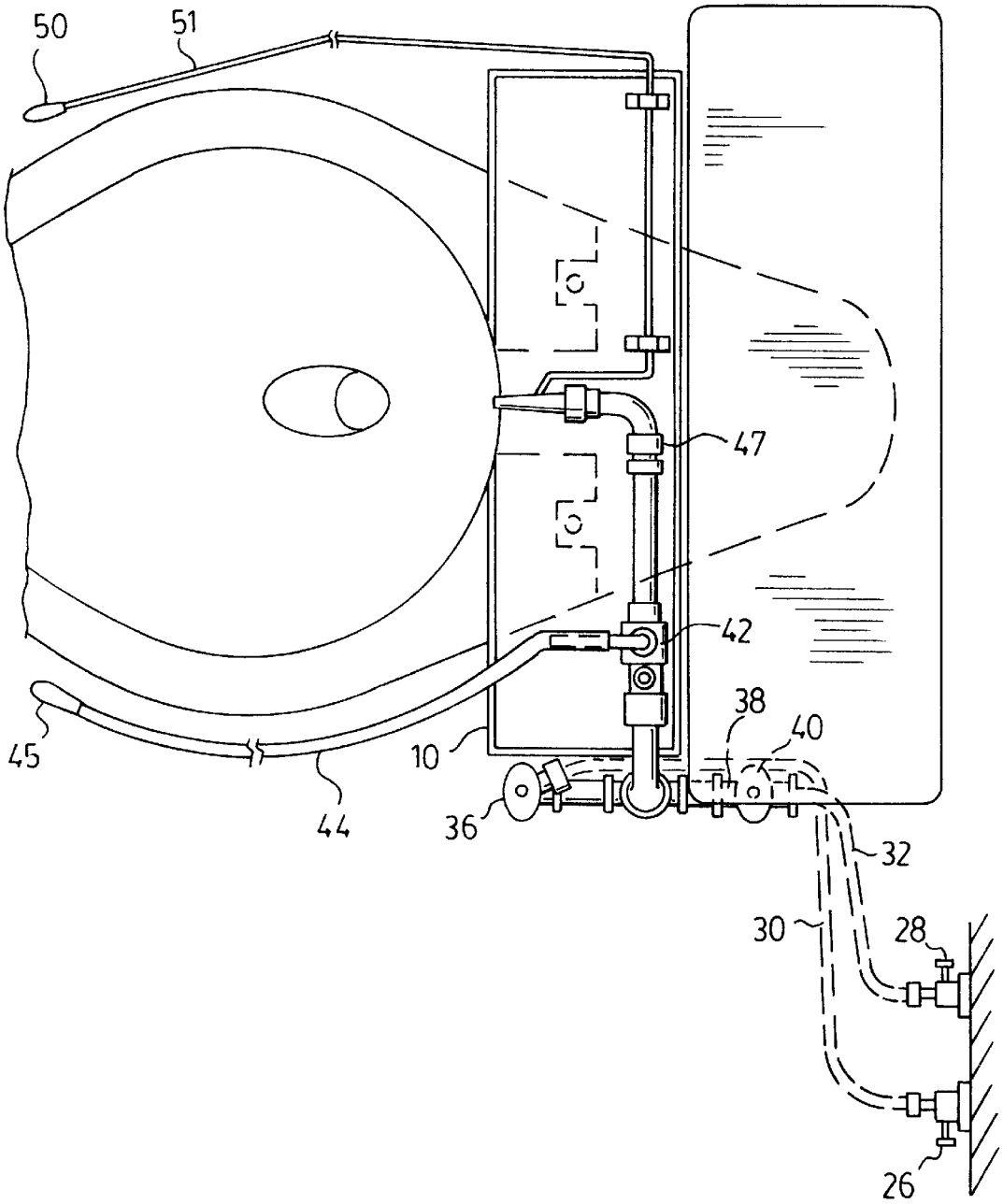
FIG. 12 is a plan view of alternative arrangement of valves in 'T' formation with the seat cover removed.
Figure 14:
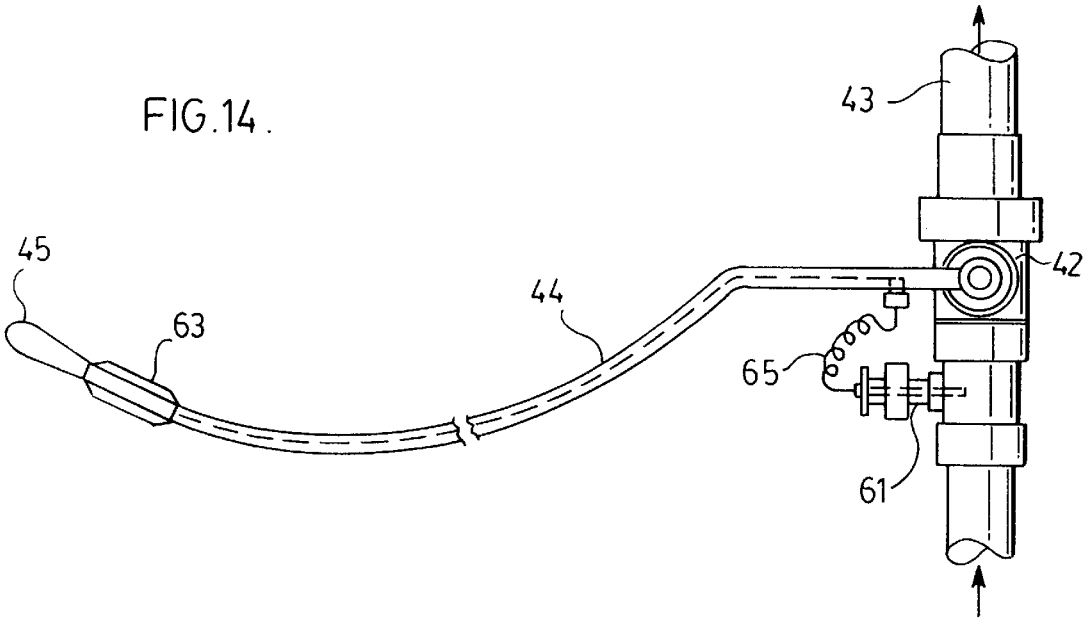
FIG. 14 is a plan view of an embodiment of flow valve handle.
Figure 17:
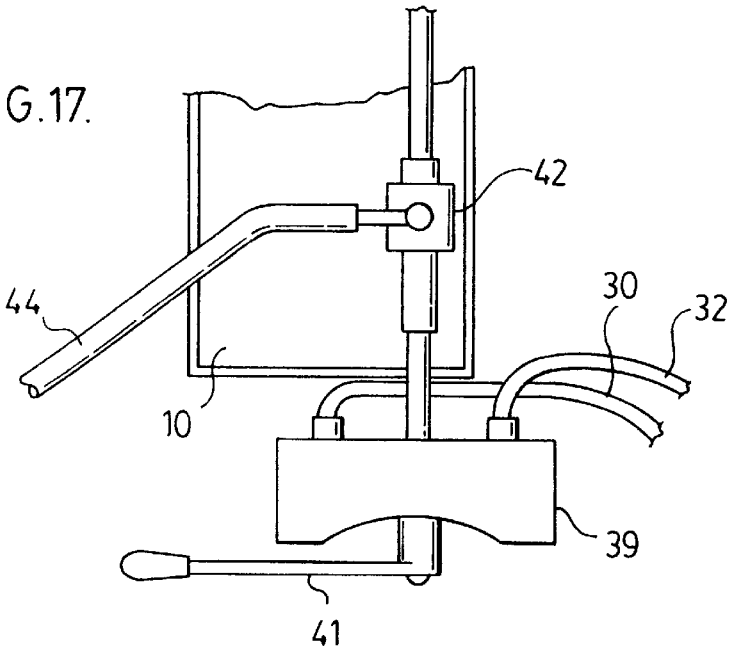
FIG. 17 is a fragmentary plan view of a disc type valve.

The mixing valve 24 can consist of a pair of conventional water valves arranged in parallel as shown in FIGS. 12 and 13 for example where valves 34 and 38 are in 'T' formation, 180° apart as compared to about 45° apart in 'Y' formation, or a disc type water valve 39 as shown in FIG. 17, well-known in the art such as made by MOEN INC., has one handle 41 to control both hot and cold water flows typically used in tub/shower baths, for hot and water supply to flow valve 42. The handles 44 and 51 can be reversed to take each other's position, the nozzle 22 and pipe 43 can be of flat design, elbow 48 can be reversed for connection for nozzle 22 to traverse larger arcs, base plate 10 could be made of plastic or metal, and valves 24, 36 and 42 can have different designs. The thermometer can be digital or analog and may be installed on base 10. Nozzle 22 can be attached to a swivel flexible adaptor 47 (FIG. 12) for motion similar to that provided by a ball joint.

Figure 15:
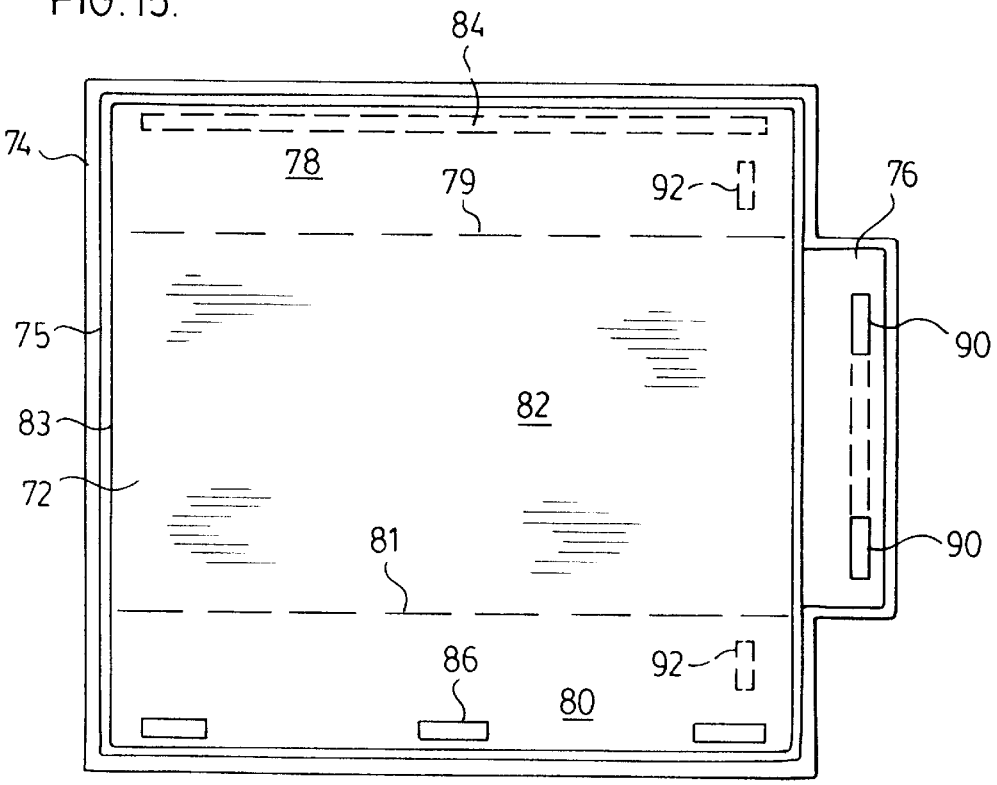
FIG. 15 is a plan view of a handtowel before folding.
Figure 16:
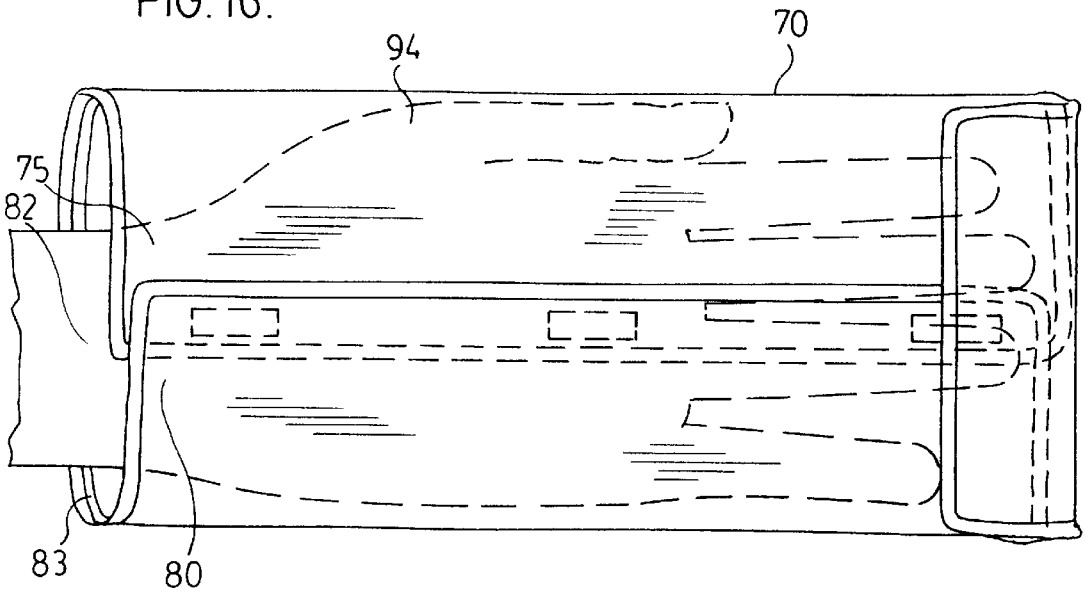
FIG. 16 is a top plan view of the handtowel in a folded, operative configuration.

With reference to FIGS. 15 and 16, handtowel glove 70 comprises a planar, generally rectangular sheet 72 of absorbent material preferably having a reinforced border 74, the interior side of the glove 14 preferably having a water proof lining. A square sheet 72 shown in FIG. 15 has a narrow rectangular extension flap 76 attached centrally at one end thereof. The side wings 78, 80 each comprised of about one-quarter of the sheet 72 are folded along fold lines 79, 81 respectively upon the central portion 82 and joined to each other by mating hook and loop fastener strips 84, 86 attached to opposite sides of sheet 72 to form a tubular shape shown in FIG. 16. Extension flap 76 is folded back onto sheet 72 to close one end of the tubular shape and secured thereto by hook and loop fastener strips 90, 92.

Handtowel glove 70 forms a closed glove to receive a hand depicted by ghost lines 94 to allow a user of the fixture to wipe and dry his or her body and then to wipe dry the toilet seat, if necessary. Turning to FIG. 1, a dispenser 96 for fresh handtowel gloves and a dispenser 98 for soiled handtowels are shown mounted on a wall in proximity to toilet 12.

It will be understood, of course, that modifications can be made in the embodiments of the invention described herein without departing from the scope and purview of the invention as defined by the appended claims.

I claim:

1. A water jet personal hygiene fixture for installation on a toilet bowl having a pair of attachment bolts comprising, a base plate having a pair of holes for receiving said attachment bolts and removably attaching the base plate to the toilet bowl, a water jet nozzle pivotally mounted on the base plate for delivering a flow of water under pressure at an angle through a vertical arc, control means operatively connected to the water jet nozzle for pivoting said water jet nozzle to a desired position within the vertical arc including an elongated vertically pivotal lever pivotally mounted at an end of the base plate, said lever having a distal end in proximity to one side of the toilet bowl, a variable flow valve in series with the water jet nozzle for controlling flow of water under pressure to the water jet nozzle mounted on the base plate, control means operatively connected to the flow valve for actuating and adjusting the flow valve including an elongated flow valve lever pivotally mounted on the flow valve at the opposite end of the base plate, said lever having a distal end in proximity to the opposite side of the toilet bowl, a thermometer read-out installed in said flow valve lever, a temperature probe installed in series between the water jet nozzle and variable flow valve for measuring water temperature, and a wire conductor connecting the temperature probe to the thermometer read-out, conduit means for connecting said flow valve to separate sources of hot and cold water supplies, a mixing valve in series with said conduit means having valve means for adjusting the hot and cold water supplies to achieve a desired water temperature to said flow valve, and a toilet seat pivotally mounted on the base having a cut-out at the waterjet nozzle to permit unobstructed flow of water from the water jet nozzle through the vertical arc of travel of said water jet nozzle.

2. A water jet personal hygiene fixture as claimed in claim 1 in which the mixing valve is a Y-valve having a cold water conduit and a hot water conduit connected thereto, said Y-valve having hot and cold water valve means for adjusting the relative flow of hot and cold water.

3. A water jet personal hygiene fixture as claimed in claim 1 in which the mixing valve is a pair of valves arranged in T-formation having a cold water conduit and a hot water conduit connected thereto for adjusting the relative flow of hot and cold water.

4. A water jet personal hygiene fixture as claimed in claim 1 in which the mixing valve is a disc-type water valve having a cold water conduit and a hot water conduit connected thereto for adjusting the relative flow of hot and cold water.

5. A water jet personal hygiene fixture as claimed in claim 1 in which the flow lever is horizontally pivotal.

* * * * *